US005871291A

United States Patent [19]

Kawazoe

[11] Patent Number: 5,871,291

[45] Date of Patent: Feb. 16, 1999

[54] RECORDING APPARATUS, METHOD AND INFORMATION-PROCESSING SYSTEM

[75] Inventor: Kenji Kawazoe, Yokohama, Japan

[73] Assignee: Canon Kabushiki Kaisha, Tokyo, Japan

[21] Appl. No.: 458,291

[22] Filed: Jun. 2, 1995

[30] Foreign Application Priority Data

Jun. 3, 1994 [JP] Japan ..... 6-122848

[51] Int. Cl.[6] ..... B41J 19/00

[52] U.S. Cl. ..... 400/279; 400/322; 400/903; 347/37

[58] Field of Search ..... 400/279, 320, 400/322, 328, 903; 347/37

[56] References Cited

U.S. PATENT DOCUMENTS

| | | | |
|---|---|---|---|
| 4,733,981 | 3/1988 | Takeuchi | 400/322 |
| 4,869,610 | 9/1989 | Nizhizawa et al. | 400/322 |
| 5,175,563 | 12/1992 | Fushimoto et al. | 346/76 PH |
| 5,189,436 | 2/1993 | Yoshikawa | 400/322 |
| 5,258,773 | 11/1993 | Arakawa et al. | 400/279 |
| 5,433,451 | 7/1995 | Hieda et al. | 400/322 |
| 5,527,121 | 6/1996 | Santon | 347/37 |
| 5,547,295 | 8/1996 | Kanemitsu | 400/279 |

FOREIGN PATENT DOCUMENTS

| | | | |
|---|---|---|---|
| 58-163686 | 9/1983 | Japan | 400/322 |
| 58-185284 | 10/1983 | Japan | 400/322 |
| 62-278071 | 12/1987 | Japan | 400/322 |
| 4-131265 | 5/1992 | Japan | 400/232 |
| 5-57982 | 5/1993 | Japan | 400/279 |

*Primary Examiner*—John S. Hilten
*Attorney, Agent, or Firm*—Fitzpatrick, Cella, Harper & Scinto

[57] ABSTRACT

A recording apparatus includes: a carriage that relatively moves against a recording medium, on which a recording head for recording an image of input information on a recording region of the recording medium is mounted; and a driving device for driving the carriage. Furthermore, the recording apparatus includes: a control device for driving the carriage by the driving device in accordance with a driving process of: an acceleration step for accelerating the carriage by stepwise changing the carriage's velocity from a rest level to a predetermined level and a retaining step for keeping the carriage's velocity of the predetermined level as a predetermined velocity.

34 Claims, 12 Drawing Sheets

| STEP | EXCITATION PERIOD Δ T(ms) | TOTAL PERIOD T(ms) | FREQUENCY (pps) | STEP | EXCITATION PERIOD Δ T(ms) | TOTAL PERIOD T(ms) | FREQUENCY (pps) |
|---|---|---|---|---|---|---|---|
| 1 | 4.183 | 4.183 | 239 | 19 | 0.654 | 22.466 | 1529 |
| 2 | 2.214 | 6.396 | 452 | 20 | 0.654 | 23.120 | 1529 |
| 3 | 1.717 | 8.113 | 582 | 21 | 0.654 | 23.774 | 1529 |
| 4 | 1.454 | 9.567 | 688 | 22 | 0.654 | 24.428 | 1529 |
| 5 | 1.284 | 10.851 | 779 | 23 | 0.654 | 25.082 | 1529 |
| 6 | 1.162 | 12.013 | 860 | 24 | 0.654 | 25.736 | 1529 |
| 7 | 1.070 | 13.084 | 934 | 25 | 0.636 | 26.372 | 1572 |
| 8 | 0.997 | 14.080 | 1003 | 26 | 0.620 | 26.992 | 1613 |
| 9 | 0.937 | 15.017 | 1067 | 27 | 0.605 | 27.597 | 1654 |
| 10 | 0.886 | 15.904 | 1128 | 28 | 0.590 | 28.187 | 1694 |
| 11 | 0.843 | 16.747 | 1186 | 29 | 0.577 | 28.764 | 1733 |
| 12 | 0.806 | 17.553 | 1240 | 30 | 0.565 | 29.329 | 1771 |
| 13 | 0.773 | 18.327 | 1293 | 31 | 0.553 | 29.882 | 1808 |
| 14 | 0.744 | 19.071 | 1343 | 32 | 0.542 | 30.424 | 1844 |
| 15 | 0.718 | 19.789 | 1392 | 33 | 0.532 | 30.956 | 1880 |
| 16 | 0.695 | 20.484 | 1439 | 34 | 0.522 | 31.478 | 1915 |
| 17 | 0.674 | 21.158 | 1485 | 35 | 0.513 | 31.991 | 1949 |
| 18 | 0.654 | 21.812 | 1529 | 36 | 0.504 | 32.495 | 1983 |

FIG. 7

RECORDING APPARATUS, METHOD AND INFORMATION-PROCESSING SYSTEM

BACKGROUND OF THE INVENTION

1. Field of the Invention

The present invention relates generally to a recording method and a recording apparatus for recording information including characters, images, pictures, and the like on a recording medium. Also the present invention relates to an information-processing system such as a copying machine, a facsimile machine, a printer, a word processor, and a personal computer, using such an apparatus as its output device.

2. Description of the Related Art

Heretofore, various kinds of serial-type recording apparatuses have been proposed as in the form of mounting the recording head of a wire dot matrix recording system, thermal recording system, thermal transfer recording system, ink jet recording system, or the like. The recording apparatus comprises a mobile device (hereinafter referred to as a carriage) on which the recording head is mounted for performing an image formation on a recording medium such as a sheet of paper, a piece of fabric and a sheet of plastic material for overhead projector (generally called an OHP sheet in Japan). For driving the carriage, in general, the serial-type recording apparatus further comprises a motor (mostly, a stepping motor) as a driving means.

In the following description, we will explain an ink jet recording apparatus to serve as an example for explaining a configuration of the conventional recording apparatus and its driving means and control system.

Among the conventional recording methods, the ink jet recording methods have been known as one of the non-impact methods and they are mainly grouped into two different types in that they prepare ink droplets and generate energies for ejecting the ink droplets in different manners. That is, one is of a continuous type and the other is of an on-demand type. The continuous type methods are further grouped into a charge particle control type and a spray type, while the on-demand methods are further grouped into a piezo type, a spark type, and a bubble jet type.

In the case of the method of a continuous type, a plurality of ink droplets is ejected continuously but only a required part of them is charged so as to be adhered on the recording medium but the others are of no use. In the case of the method of on-demand type, on the other hand, ink droplets are ejected when they are required for the recording process. By this method, therefore, the ink can be used without causing any useless droplets and without staining an interior of the apparatus. According to the method of on-demand type, furthermore, a response frequency of the recording means is lower than that of the continuous one because the on-demand type recording head starts and stops its ink ejection during the period of image formation. It follows from this that the high speed recording can be attained by increasing the number of nozzles of the recording head in the type of on-demand, so that a lot of recording apparatuses being commercially available are of the on-demand type.

Therefore the ink jet recording apparatus comprising the recording head of such ink jet type has been commercially manufactured and used to meet the needs for high speed recording, high resolution, high image quality, low noise, and so forth. That is, the ink jet type recording apparatus has thus been employed as printers for copy machines, facsimiles, printers, word processors, output terminals of work stations and so forth, handy or portable printers to be employed in personal computers, host computers, optical disk systems, video systems, and so forth. In these cases, the ink jet recording apparatus can be constructed and designed so as to match their individual mechanisms, operation or service conditions, and the like.

The ink jet recording apparatus generally comprises: a carriage for carrying a recording means (i.e., a recording head) and an ink tank; a transfer means for transferring a recording medium (e.g., a sheet of recording paper); and a control means for controlling the drive of these means. In the ink jet recording apparatus, the ink jet recording head performs its serial scanning movement (i.e., the head scans over a surface of the recording head sequentially) along the direction (main-scanning direction) perpendicular to the direction (sub-scanning direction) of transmitting the recording medium for ejecting ink droplets from a plurality of ejection orifices, while the recording medium is intermittently shifted at a distance corresponding to a recording width of the recording medium.

The process of ink jet recording is characterized by ejecting ink droplets on the recording medium in accordance with the recording signals, so that it has been widely applied in various systems as a noiseless recording process with an inexpensive running cost. By using the recording head comprising a plurality of ink-ejecting nozzles linearly arranged in the sub-scanning direction, an image having a width thereof corresponding to the number of the nozzles can be recorded by a single scanning movement of the recording head. Consequently, high-speed recording movement can be attained.

As described above, however, the aforementioned conventional recording apparatus uses in general the motor (mainly the step motor, i.e., pulse motor, to be revolved in accordance with input pulse) as a driving means for driving the carriage. The motor is responsible for shifting a position of the carriage in the main-scanning direction with respect to the recording medium. On this occasion, in general, the motor is set into rotation at a constant rate by producing an acceleration, i.e., by gradually increasing the speed of rotation. In the conventional recording apparatus, furthermore, a failure of driving the carriage ordinarily at a constant rate (i.e., situations in which acceleration varies) would create instability in image qualities, especially just after the carriage reaches at the predetermined recording rate from a rest state of the motor. For decreasing the instability in image qualities in most of the conventional recording apparatuses, therefore, prior to the recording of image, a recording speed of the carriage is kept at a constant by accelerating from the rest state to the predetermined level to attain the recording speed. By the way, a time interval from rest is required to attain a constant recording speed after accelerating the carriage. The time interval becomes longer when the recording speed is higher than that of the usual, with the result that an approach run of the carriage for the recording movement requires a longer area. It means that a recording area of the recording medium decreases with increase in the recording speed. Thus a problem to be solved is to increase the recording speed without decreasing a recording area of the recording apparatus.

FIGS. 1 and 2 show the time variation of the carriage's velocity for explaining a typical acceleration of a carriage-driving motor (e.g., a magnetic stepping motor) at the period of driving the carriage to be installed in the conventional ink jet recording apparatus. In these figures, the vertical axis is for a transport velocity of the carriage and the horizontal axis is for a lapse of time.

For transporting the carriage by driving the magnetic stepping motor, the so-called open loop control is generally used in such driving. In this case, a detection of the carriage's position is not performed after sending a control signal to the motor. Therefore we cannot detect whether the motor or the carriage is being driven in accordance with the control signal.

In FIGS. 1 and 2, control values of the carriage's velocity at successive times, which are experimentally obtained, are plotted as a thick line D, while each control value practically obtained is plotted as a narrow line (E). In the case of an example as shown in FIG. 1, the carriage's motion is controlled as a uniformly accelerated linear motion. Therefore the carriage's velocity is constantly increased to a predetermined velocity (i.e., a control value) Vk and then the carriage's velocity is kept at a constant without deviating from that value Vk by means of controlling a drive of the carriage motor. In spite of such control, however, an actual position of the carriage is deviated from the expected position with respect to the control value Vk because of variations occurring in the carriage's velocity at successive times. That is, just after the acceleration the carriage once travels at a velocity of over Vk. Then the carriage's displacement can be successively performed at higher and lower velocities in a repetitive manner, with respect to the control value Vk. This kind of variation in the carriage's velocity can be observed in spite of passing the carriage over the point of starting the recording movement.

FIG. 2 shows an example of controlling the carriage's motion by means of a combination of exponential components instead of using the uniformly accelerated linear motion. In this case, however, variations in the carriage's velocity can be also observed after the carriage's acceleration, in spite of passing over the recording start position.

If the variation in the carriage's velocity is continued after starting the recording of an image on a recording medium, the resulting image can be disrupted. To solve this problem, it has been required to converge the above variations during the period between the end of acceleration and the start of recording.

During the period between the time of starting the recording movement and the time of ending the acceleration, the carriage tends to locate on the far side of each expected position at the successive times. In this case, it is noted that the extent to which the carriage's location is deviated from the expected position with respect to the velocity is gradually enlarged with the time, involving that the extent of variations in the carriage's velocity is also enlarged.

At the time of starting the acceleration, the carriage receives a force of the following equation:

$$F=Ma$$

(where "F" denotes a force, "M" denotes a weight of the carriage, "a" denotes an acceleration).

When the force F is applied on the carriage at a moment of starting the acceleration, the carriage starts to move at a velocity slower than the above control level Vk for a very short period because of stretching a belt member or of hardness of other members for transporting the carriage. After that short period, the carriage moves at a velocity higher than the above control level because of a repulsion force to bring back the shape of the belt member or the like. When the repulsion force is not enough, the acceleration can be finished with a delayed movement of the carriage, depending on the configuration of the transport device. A degree of the force F to be applied on the carriage at the time of accelerating the carriage's motion is directly proportionate to the degree of acceleration, so that the above variations in the carriage's velocity can be converged by decreasing the acceleration. However, it requires a comparatively larger device for providing a longer distance to accelerate the carriage's motion.

Accordingly, it has been required to finish the acceleration of the carriage's motion within a short period by rapidly accelerating the carriage.

SUMMARY OF THE INVENTION

An object of the present invention is to provide a recording apparatus, a recording method, and an information processing system, for providing a high-qualified image by attaining a stable recording movement by controlling an acceleration of the carriage's motion in a short distance without reducing the space of the recording movement and without increasing a size of the apparatus.

In a first aspect of the present invention, there is provided a recording apparatus including: a carriage that relatively moves against a recording medium, on which a recording head for recording an image of input information on a recording region of the recording medium is mounted; and a driving means for driving the carriage, the recording apparatus comprising:

- a control means for driving the carriage by the driving means in accordance with a driving process of:
  - an acceleration step for accelerating the carriage by stepwise changing the carriage's velocity from a rest level to a predetermined level; and
  - a retaining step for keeping the carriage's velocity of the predetermined level as a predetermined velocity.

The acceleration step may comprise at least two sub-steps:

- a first acceleration sub-step for accelerating the carriage from the rest level to a predetermined transient level; and a second acceleration sub-step for accelerating the carriage from the predetermined transient level to the predetermined level.

An acceleration in the first acceleration sub-step may be different from an acceleration in the second acceleration sub-step.

The first acceleration sub-step may be longer than the second acceleration step.

An acceleration at the transient level of the acceleration step may take a value of 0.

The driving process of the control means may further comprise a deceleration step for decelerating the carriage by stepwise changing the carriage's velocity from the predetermined level to the rest level.

The deceleration step may comprise at least two sub-steps:

- a first deceleration sub-step for decelerating the carriage from the predetermined level to a predetermined transient level; and a second deceleration sub-step for decelerating the carriage from the predetermined transient level to the rest level.

A deceleration in the first deceleration sub-step may be different from a rate of deceleration in the second deceleration sub-step.

A deceleration of the first deceleration sub-step may be larger than a rate of deceleration of the second deceleration sub-step.

A deceleration in the transient level of the deceleration step may take a value of 0.

The retaining step may select one velocity from a plurality of velocities as the predetermined velocity.

The control means may determine a rate of acceleration in the acceleration step with respect to the selected velocity.

The control means may determine a rate of acceleration in the acceleration step and a rate of deceleration in the deceleration step with respect to a moment of inertia or a load condition of the driving means.

The driving means may be a pulse motor to be driven in accordance with a pulse signal.

The recording means may be a DC motor.

The recording head may not record the input image information on the recording medium in the acceleration step.

The recording head may include a thermoelectric transducer for allowing a phenomenon of film boiling to appear in ink, the thermoelectric transducer serving to generate energy for ejecting ink droplets therefrom.

In a second aspect of the present invention, there is provided a recorded material on which an image of input information is recorded by a recording apparatus including: a carriage that relatively moves against a recording medium, on which a recording head for recording the image of input information on a recording region of the recording medium is mounted; and a driving means for driving the carriage, the recording apparatus comprising:

a control means for driving the carriage by the driving means in accordance with a driving process of:

an acceleration step for accelerating the carriage by stepwise changing the carriage's velocity from a rest level to a predetermined level; and a retaining step for keeping the carriage's velocity of the predetermined level as a predetermined velocity.

In a third aspect of the present invention, there is provided an information processing system using a recording apparatus as an output means, the recording apparatus including: a carriage that relatively moves against the recording medium, on which a recording head for recording the image of input information on a recording region of the recording medium is mounted; and a driving means for driving the carriage, the recording apparatus comprising:

a control means for driving the carriage by the driving means in accordance with a driving process of:

an acceleration step for accelerating the carriage by stepwise changing the carriage's velocity from a rest level to a predetermined level; and a retaining step for keeping the carriage's velocity of the predetermined level as a predetermined velocity.

The information processing system may be a copying machine.

The information processing system may be a facsimile machine.

The information processing system may be a personal computer.

In a fourth aspect of the present invention, there is provided a method of recording an image of input information on a recording medium by a recording apparatus including: a carriage that relatively moves against the recording medium, on which a recording head for recording the image of input information on a recording region of the recording medium is mounted; and a driving means for driving the carriage, the recording apparatus comprising:

a control means for driving the carriage by the driving means in accordance with a driving process of:

an acceleration step for accelerating the carriage by stepwise changing the carriage's velocity from a rest level to a predetermined level; and a retaining step for keeping the carriage's velocity of the predetermined level as a predetermined velocity.

The acceleration step may comprise at least two sub-steps:

a first acceleration sub-step for accelerating the carriage from the rest level to a predetermined transient level; and a second acceleration sub-step for accelerating the carriage from the predetermined transient level to the predetermined level.

An acceleration in the first acceleration sub-step may be different from an acceleration in the second acceleration sub-step.

The first acceleration sub-step may be larger than the second acceleration step.

An acceleration at the transient level of the acceleration step may take a value of 0.

In a fifth aspect of the present invention, there is provided a process comprising a deceleration step for decelerating the carriage by stepwise changing the carriage's velocity from the predetermined level to the rest level.

The deceleration step may comprise at least two sub-steps:

a first deceleration sub-step for decelerating the carriage from the predetermined level to a predetermined transient level; and a second deceleration sub-step for decelerating the carriage from the predetermined transient level to the rest level.

A rate of deceleration in the first deceleration sub-step may be different from a rate of deceleration in the second deceleration sub-step.

A rate of deceleration of the first deceleration sub-step may be larger than a rate of deceleration of the second deceleration sub-step.

A rate of deceleration in the transient level of the deceleration step may take a value of 0.

The retaining step may select one velocity from a plurality of velocities as the predetermined velocity.

The control means may determine a rate of acceleration in the acceleration step with respect to the selected velocity.

The control means may determine a rate of acceleration in the acceleration step with respect to a moment of inertia or a load condition of the driving means.

The driving means may be a pulse motor to be driven in accordance with a pulse signal.

The recording means may include a DC motor.

The recording head may not record the input image information on the recording medium in both the acceleration step and the deceleration step.

The recording head may include a thermoelectric transducer for allowing a phenomenon of film boiling to appear in ink, the thermoelectric transducer serving to generate energy for ejecting ink droplets therefrom.

The above and other objects, effects, features, and advantages of the present invention will become more apparent from the following description of embodiments thereof taken in conjunction with the accompanying drawings.

BRIEF DESCRIPTION OF THE DRAWINGS

The present invention is illustrated in the following drawings in which:

FIG. 7 is an acceleration table of a motor as an embodiment of a carriage's drive control of a recording apparatus in accordance with the present invention;

DETAILED DESCRIPTION OF THE PREFERRED EMBODIMENTS

A recording apparatus in accordance with the present invention performs the process for driving a carriage. The process comprises the steps of: accelerating motion carriage's motion by stepwise increasing velocity from a rest state to a predetermined level and keeping the carriage's motion at the predetermined velocity. Preferably, the above process has a time interval in which there is no change in velocity (i.e., both acceleration and deceleration cannot be observed). As a consequence, it is possible to decrease the variations in velocity after terminating the acceleration and to decrease the deviation of the carriage's location from an expected position with respect to the carriage's drive control level, which are regarded as causes of generating a disordered portion in a recorded image. That is, the recording apparatus makes a condition like one at the time of finishing the acceleration by controlling the carriage's motion at a constant velocity to approach the carriage's location to an expected position with respect to the above predetermined velocity, with the result that a difference between the carriage's location and the expected position with respect to the above predetermined velocity can be converged. By re-accelerating the carriage's motion, furthermore, a difference between the carriage's location and the expected position with respect to the above predetermined velocity can be converged at a moment of finishing the acceleration. Consequently, the above variations in velocity can be decreased in proportion to a decrease in the difference between the carriage's location and the expected position with respect to the above predetermined velocity.

The present invention will now be described in detail hereinafter with reference to the accompanying drawings which illustrate preferred embodiments thereof.

<Embodiment 1>

Figure 1:
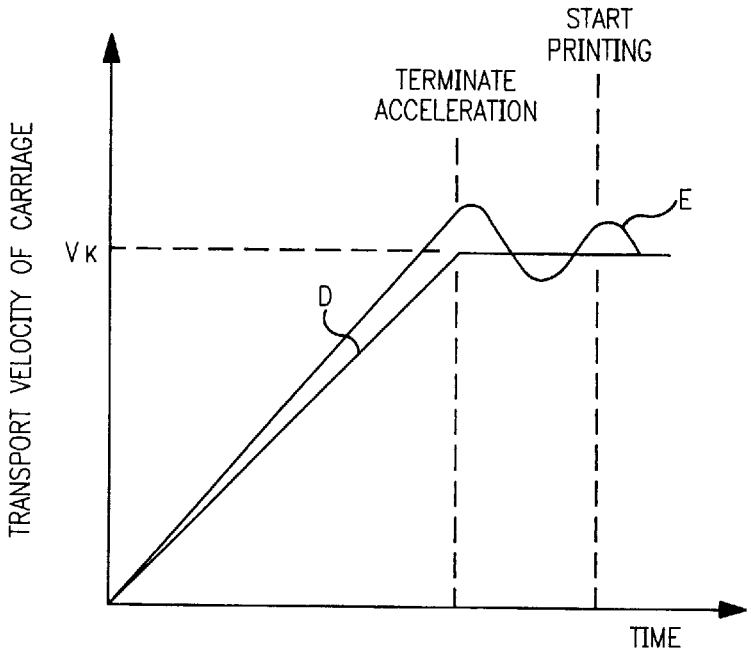
FIG. 1 PRIOR ART
FIG. 1 is a graph showing an example of the relationship between an actual carriage's location and a carriage's drive control of a conventional recording apparatus.
Figure 2:
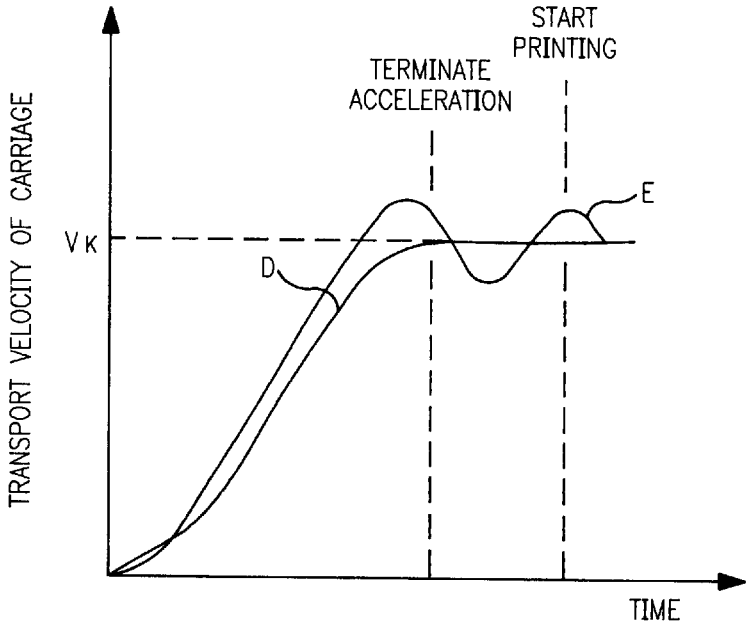
FIG. 2 PRIOR ART
FIG. 2 is a graph showing another example of the relationship between an actual carriage's location and a carriage's drive control of a conventional recording apparatus.
Figure 3:
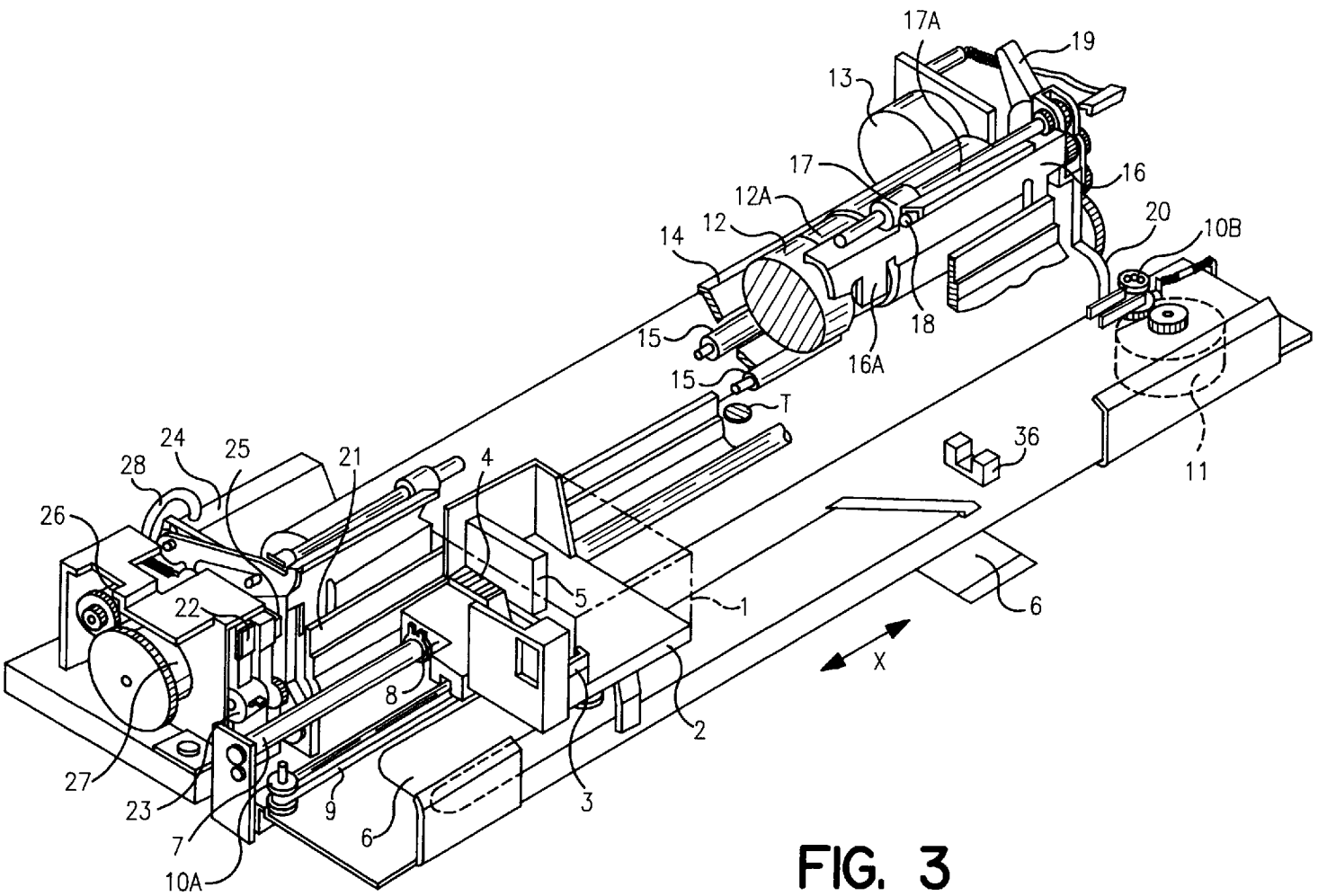
FIG. 3 is a schematic perspective view of a configuration of a recording apparatus in accordance with the present invention.

FIG. 3 is a schematic perspective view of an ink jet recording apparatus in accordance with the present invention.

In the figure, reference numeral 1 denotes a head cartridge having an ink jet recording head, and reference numeral 2 denotes a carriage on which the head cartridge 1 is mounted. The carriage 2 transports the head cartridge 1 in the main-scanning direction (the direction of arrow X in the figure).

In this embodiment, the recording head is of the type that employs an electro-thermal transducer 1*b* as an energy-generating member, so that the recording head is able to perform an ejection of ink droplets with a high responsiveness by instantaneously and suitably growing and collapsing a bubble in each liquid path by applying an electric pulse signal in the proportion of one signal to one bubble.

In the figure, furthermore, reference numeral 3 denotes a hook for holding the head cartridge 1 on the carriage 2, reference numeral 4 denotes a lever for operating the hook 3, reference numeral 5 denotes a supporting plate for supporting an electric connecting portion with respect to the head cartridge 1, and reference numeral 6 denotes a flexible printed circuit (FPC) for electrically connecting between the electric connecting portion and a main body's control unit.

Also, reference numeral 7 denotes a guide shaft passing through a shaft bearing 8 of the carriage 2 for guiding the movement thereof.

Reference numeral 9 denotes a timing belt which is being pulled by a pair of pulleys 10A, 10B on opposite sides of the apparatus and runs by a drive force of a carriage motor 11 through a transmission including gears for transporting the carriage 2 in the direction X, Reference numeral 12 denotes a feed roller which is driven by a feed motor 13 for feeding a recording medium such as a recording paper and for positioning a recording surface thereof during the recording process, reference numeral 14 denotes a paper pan for guiding the recording medium to a recording position, reference numeral 15 denotes a pinch roller positioned on a path of feeding the recording medium for pressing the recording medium against the feed roller 12 to transport it, and reference numeral 16 denotes a platen that positions the recording surface of the paper and holds it so as to face to ejection ports of the head cartridge 1.

Reference numeral 17 denotes an output roller for removing the recording paper from an outlet portion (not shown), reference numeral 18 denotes a spur-like wheel for pressing the paper on the output roller 17 to cause a force of transporting the paper against the roller 17, and reference numeral 19 denotes a release lever for setting the paper free from the pinch roller 15 and the spur-like wheel 18.

Both ends of the platen 16 are supported by an axis of the output roller 17 in a turnable manner and pressed toward a whole surface 21 of the paper pan 14 from rest positions of left and right plates 20, so that a plurality of portions 16A of the platen 16 are contacted with an inner side of the paper pan 14, where each portion 16A is faced to each portion 12A of the roller 12. As shown in the figure, a plurality of the portions 12A are formed on a peripheral surface of the roller 12 as recessed areas with a comparatively smaller diameter.

Reference numeral 22 is a cap member made of an elastic material such as rubber, facing to an ejection surface of the recording head at a home position where the recording head rests to cease the recording movement. The cap member 22 is supported so as to be able to contact on and to remove from the recording head. The cap member 22 is used for protecting the recording head and for the process of recovering an ejection ability thereof under the condition of resting the recording movement. In general, there are two types of the recovering processes. One comprises the step of the so-called spare ejection. In this process, the cap member is placed at a front of the ejection surface of the recording head and factors of ejection failure, such as bubbles, dust particles, and baked ink portions which are unacceptable for the ink ejection, are removed by ejecting ink from all of the ejection ports by driving the energy generating elements installed in the ejection ports. On the other hand, another process comprises the step of capping the ejection surface of the recording head by the cap member and compulsorily ejecting ink from the ejection ports to remove the factors of ejection failure.

Reference numeral 23 denotes a pump for absorbing the ink received in the cap member 22 when the recovering process is performed. Reference numeral 24 denotes a waste-ink reservoir for reserving the waste ink absorbed by the pump 23. The waste-ink reservoir is communicated with the pump 23 through a tube 28.

Reference numeral 25 denotes a blade that wipes the ejection surface of the recording head. The blade 25 is projected toward the recording head and is movably supported on a position of wiping the recording head at the time of the carriage's movement and a backward position where the blade does not contact with the ejection surface of the recording head. Reference numeral 26 is a motor and 27 is a cam mechanism for producing variable or reciprocating motion of the pump 23, cap member 22, and blade 25 by receiving a drive force of the motor 27.

As shown in the figure, the recording apparatus comprises a temperature sensor T for measuring a temperature of an inner side of the recording apparatus (i.e., environmental temperature). The temperature sensor T is a well-known thermistor thermometer that processes a negative temperature coefficient (i.e., resistance decreases as temperature increases) and indicates an output voltage as a measuring result in accordance with the variations in temperature. Then the output signal is introduced into MPU 100 as described later, after passing through the signal amplification circuit and the like.

Figure 4:
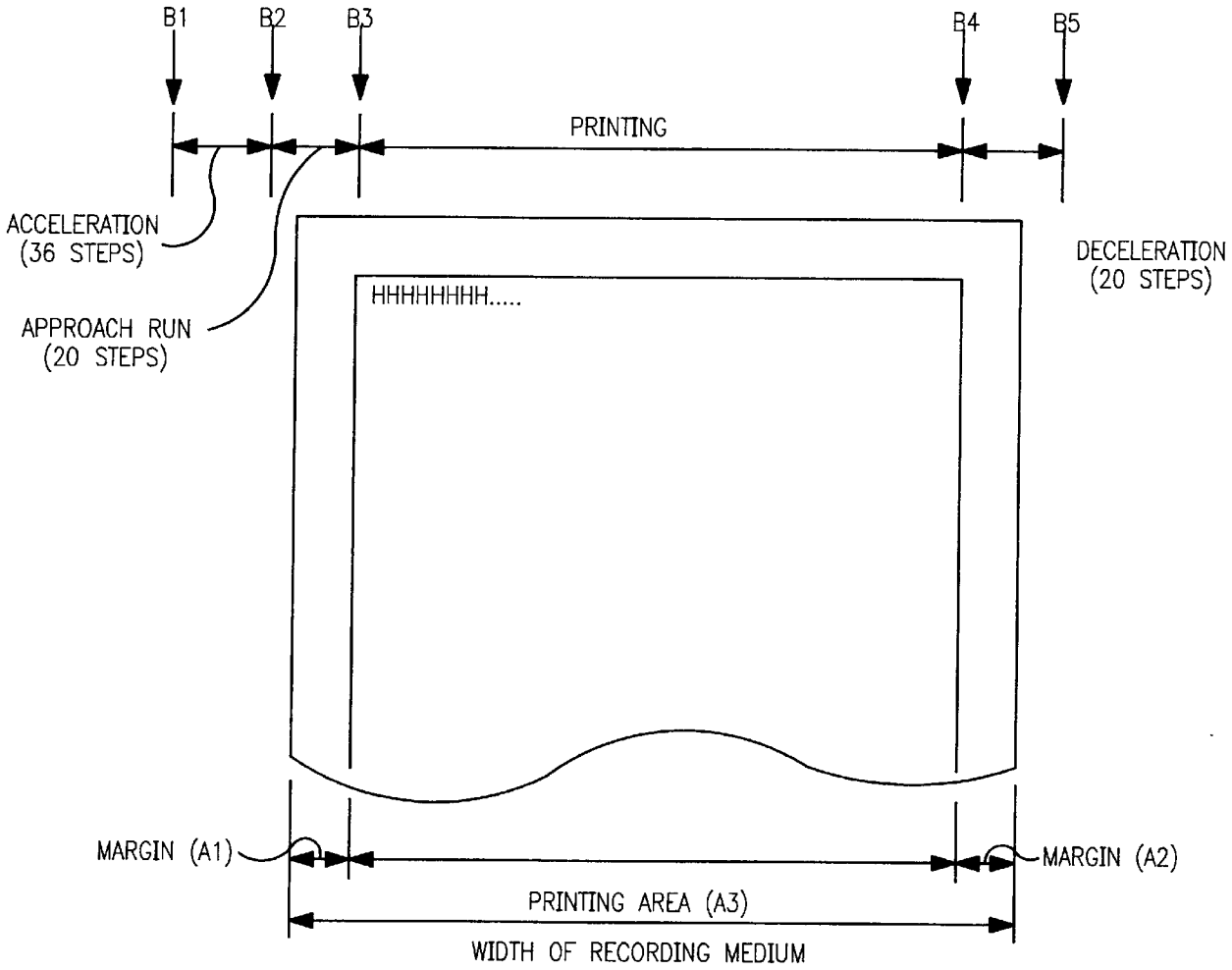
FIG. 4 is a partial plan view of a recording medium for explaining the positional relationship between the recording medium and its recording area and a carriage of a recording apparatus in accordance with the present invention.

FIG. 4 is a partial plan view of a recording medium for explaining the relationship among a recording medium, a recording area thereof, and a carriage of a recording apparatus with respect to their positions in accordance with the present invention.

In this embodiment, the recording head records one dot on the recording medium during the period that the motor is driven by one pulse. As shown in the figure, the recording medium has space regions A1 and A2 on its both sides and a recording region A3 between these space regions in the horizontal direction. That is, the recording head records an image on the recording region A3 but not on the space regions A1 and A2.

In FIG. 4, the position B1 of starting the carriage's movement is on the upper stream side in the recording direction. The carriage is accelerated from the position B1 to the position B2 (36 steps), and then the carriage performs the so-called approach run from the position B2 to the position B3 (20 steps), without performing the recording, at the velocity corresponding to that of the recording movement. When the carriage has just arrived on the position B3, the recording head starts to perform the recording movement. After the recording movement, the carriage's velocity is gradually decreased as a deceleration (36 steps). In general, the distance to be traveled by the carriage is longer than a length of the recording region A3. Therefore, if the acceleration and deceleration of the carriage are performed within the recording region, the recording apparatus can be downsized. In general, however, the carriage requires a little time for stabilizing the carriage's motion just after the acceleration. For this reason, there is the regions of acceleration and approach run in the present embodiment. Thus a fundamental requirement for downsizing the recording apparatus is to make the distance of these regions short.

Figure 5:
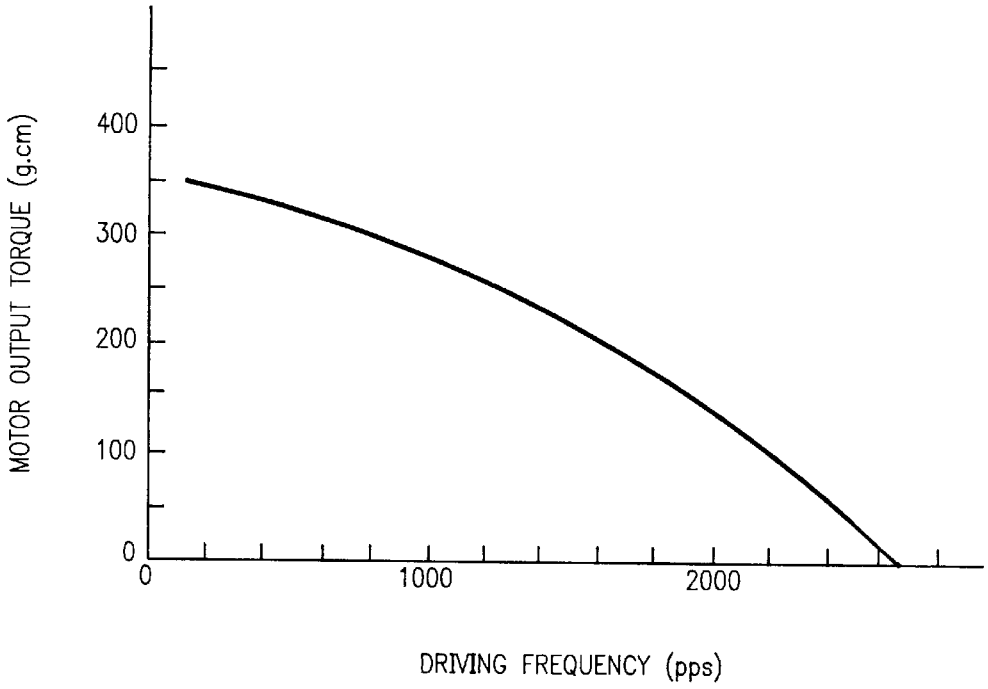
FIG. 5 is a graph showing the relationship between an output torque and a drive frequency of a magnetic stepping motor to be applied as a carriage's driving source of a recording apparatus in accordance with the present invention.

FIG. 5 shows the relationship between a driving frequency of a stepping motor which is used as a driving source for driving the carriage and a torque of such motor.

In general, the smaller the driving frequency, the likelier it becomes that the stepping motor tends to increase its output torque. On the other hand, the higher the driving frequency, the likelier it becomes that the stepping motor tends to decrease its output torque. For this reason, the carriage's acceleration is performed in a manner that the driving frequency of the motor is gradually increased from the lower level corresponding to the high output torque when the stepping motor is driven.

Hereinafter, we will explain the process of controlling of the carriage's motion in the recording apparatus having the above construction.

Figure 6:
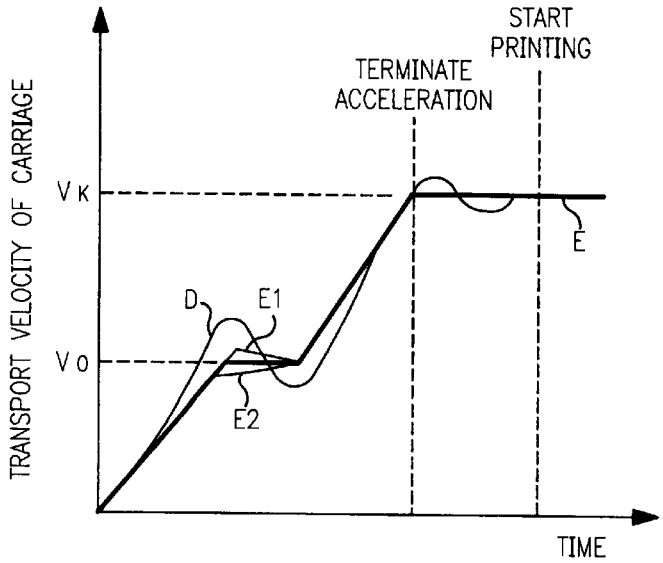
FIG. 6 is a graph showing the relationship between an actual carriage's location and a carriage's drive control of a carriage of a recording apparatus in accordance with the present invention.

FIG. 6 shows the relationship between a control level and a carriage's position in accordance with the present embodiment.

In the present invention, the carriage's acceleration is controlled so as to be uniformly accelerated. Before the carriage reaches the predetermined recording velocity (i.e, control level Vk in the figure, corresponding to the motor's driving frequency of 2,000 pps), which is suitable for the recording, there is a region to control the carriage's motion once at constant velocity so as to move the carriage without change in velocity per unit time (i.e., the carriage's acceleration is zero). By providing the region where the carriage's acceleration is zero, it is possible to reduce oscillation in velocity after accelerations and to reduce deviation of the carriage's actual position from the expected position relative to the above control level, which are factors which affect quality of the recorded image. During the period of accelerating the carriage's motion, the carriage's position is once shifted without change in velocity per unit time for breaking the situation that the carriage is positioned in front of the expected position with respect to the carriage's acceleration. That is, the actual position of the carriage is brought near to the expected position corresponding to the control level by making the same situation as that of finishing the acceleration by regulating the carriage's velocity at a constant, with the result that the above deviation can be decreased. After moving the carriage at the above constant velocity, it is re-accelerated to further diminish the above deviation between the carriage's position and the expected position just after the step of acceleration, and the above variations can be also decreased as a result of decreasing the deviation.

In the present embodiment, the recording apparatus has a region of zero acceleration, but the invention is not so limited. It is possible to use the region of performing a smaller acceleration compared with that of others as shown in the dot lines E1 and E2 in the figure. In this case, that is, the region of performing a smaller acceleration is positioned between the regions for performing the acceleration higher than that of the former.

In FIG. 6, E1 denotes the condition that the carriage's acceleration is negative (i.e., deceleration) and E2 denotes the region having smaller acceleration. In these methods, it is preferable to determine the optimum value of the acceleration in accordance with the conditions such as the moment of inertia of the above carriage driving system.

In this embodiment, as shown in FIG. 5, the carriage is uniformly accelerated, so that the carriage receives a force F constantly during the stage of acceleration. The force F is written as the following equation:

$$F=Ma$$

(where "F" denotes a force, "M" denotes a weight of the carriage, "a" denotes an acceleration.)

Figure 13:
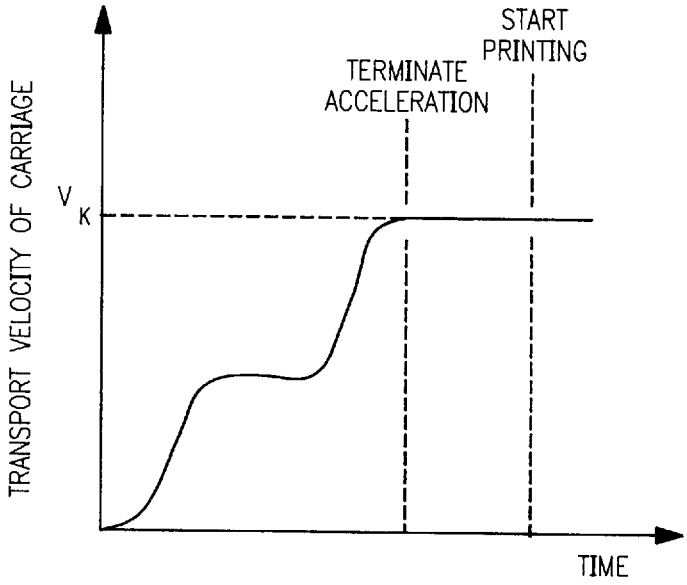
FIG. 13 is a graph showing a carriage's drive control of a recording apparatus in accordance with the present invention.

In this embodiment, the carriage receives no force (i.e., F=0) at the instant at which the carriage enters the region to move at the constant velocity on the halfway point of the stage of acceleration and at the instant at which the acceleration has terminated. However, the above variations in velocity can occur at the instant the force F disappears. In the case of uniform acceleration, however, the amount of change in force applied on the carriage is being constant because of the constant value of the force F. As shown in FIG. 13, however, the output torque of the stepping motor decreases as the driving frequency thereof increases, so that the variations in velocity can occur because of an unstable drive of the carriage under the condition of lower output torque at higher driving frequency of the stepping motor in spite of the amount of change in force that applies on the carriage being constant. Thus the variations in velocity can occur because the carriage drives unstably under the condition of lower output torque which is caused by an increase of the driving frequency.

Furthermore, the above force F (F=Ma) is proportionate to the weight M of the carriage, so that a magnitude of the force F can be varied under the conditions of using different carriage's driving mechanism, different size or weight of recording head, and the like. In the case of the region for slow acceleration, therefore, it is preferable to individually and appropriately determine a degree and an extent of acceleration with respect to each condition.

In the case that a plurality of the numerical values of recording and transporting speeds is established (i.e., a plurality of the numerical values of "Vk" is defined in the figure), it is also preferable to individually and appropriately determine a degree and an extent of acceleration with respect to each condition.

FIG. 7 is a table for controlling an acceleration of the carriage motor of the present embodiment. In this embodiment, as described above, the motor performs the acceleration as a plurality of steps of acceleration in a stepwise manner. In this case, the acceleration includes 36 steps and reaches to a driving frequency (2,000 pps) of the recording speed at the 37th step. For each step in the table, a period of exciting the motor is indicated as DT (ms) in a column, while accumulated periods (i.e., total period at each step) from an initial acceleration to each step is indicated as T (ms) in another column. From step 18 to step 24, their excitation periods take the same value of 0.654 (ms). This means that the carriage moves at a constant speed without acceleration in the range of these steps.

Figure 8:
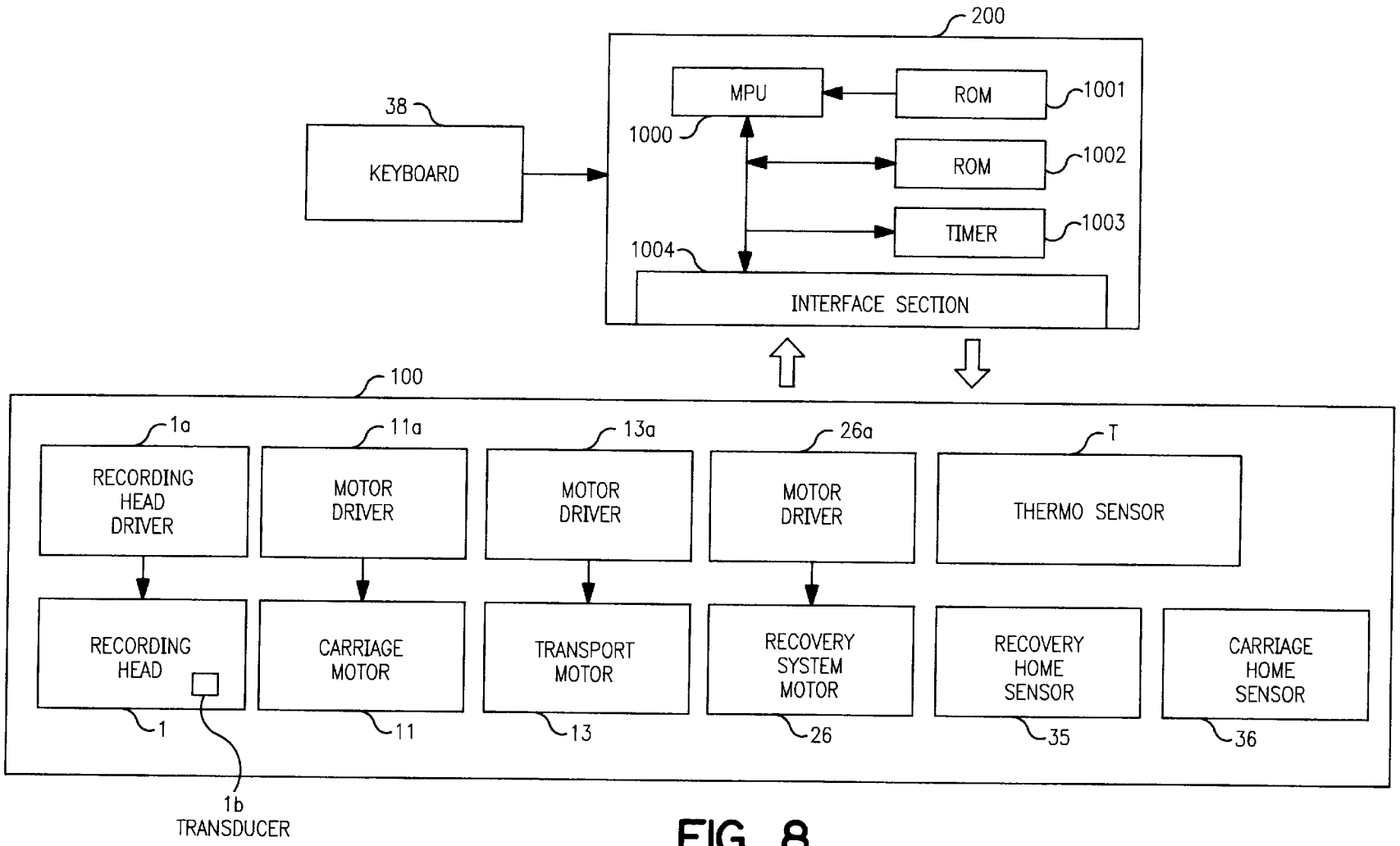
FIG. 8 is a block diagram showing a control unit of a recording apparatus in accordance with the present invention.

FIG. 8 is a block diagram for exemplifying a construction of a control unit 200, a keyboard 38, and a remainder 100 of the ink jet recording apparatus. In the figure, reference numeral 1000 denotes MPU (micro processing unit) for controlling each portion by performing a control procedure such as programs prepared in advance. Reference numeral 1001 denotes ROM (read-only memory) for storing programs corresponding to the control member. Reference numeral 1002 denotes RAM (random-access memory) to be used as a work area for performing the control procedure. Reference numeral 1003 denotes a timer that calculates times of performing the control procedure or the like. Reference numeral 1004 denotes an interface portion for connecting with each portion of the printer. Reference numeral 38 denotes a keyboard for entering various commands by pressing or typing keys. Also, the reference numerals 1*a*, 11*a*, 13*a*, and 26*a* denote drivers for driving the recording head 1, carriage motor 11, feed motor 13, and recovering system's motor 26, respectively. In addition, a thermosensor for detecting an environment temperature of the recording apparatus is indicated by the letter T.

In this embodiment, furthermore, the recording apparatus is constituted so as to detect a capping position and a shifted position of the carriage by means of the recovering system's home sensor and carriage home sensor, respectively.

Figure 9:
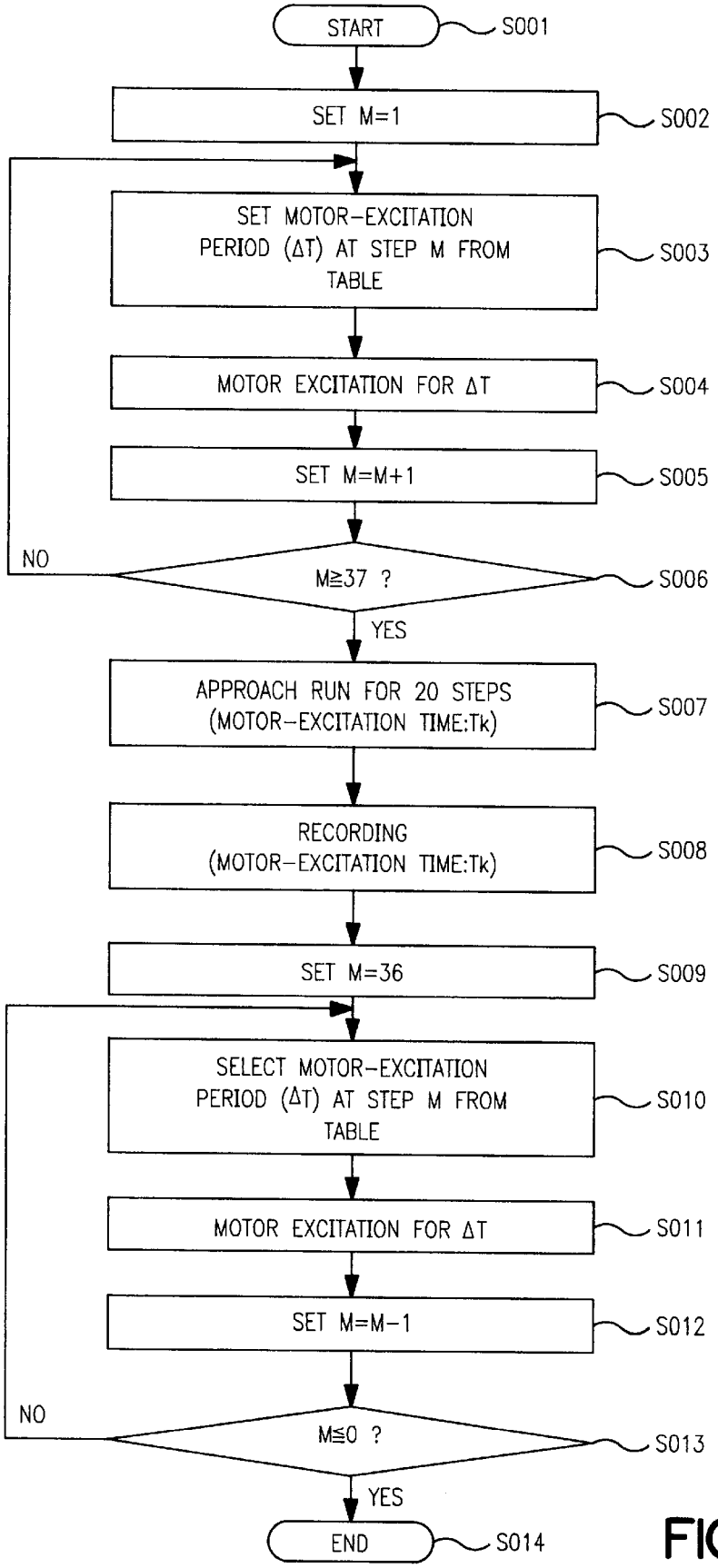
FIG. 9 is a flow chart showing the process for controlling a carriage's motion in a recording apparatus in accordance with the present invention.

FIG. 9 is a flowchart for explaining the control procedure in accordance with the present embodiment. The flowchart illustrates the control procedure for recording a single line of image. Therefore, a plurality of lines can be recorded by repeating the above procedure.

First of all, in the flowchart, the control unit receives orders of recording the image (S001). In MPU 1000, a variable M is defined as 1 (i.e., M=1) (S002). After setting the variable, the excitation period ΔT corresponding to the step 1 is selected from the table shown FIG. 7 (S003). The table is housed in ROM 1001 in advance. For the excitation period ΔT, the motor is driven (S004). In the next step, the variable M receives additional 1 to the M value obtained at the preceding step (i.e., M=M+1) (S005) and then the excitation period ΔT corresponding to the step M is selected from the table shown FIG. 7. In this embodiment, the carriage can be accelerated for 36 steps, so that the steps S003 to S005 are repeated until the variable M takes the value of 36. When the M takes the value of 37, the carriage's acceleration is terminated (S006) and then the carriage repeatedly performs an approach run up to 20 steps at the time interval of DT that corresponds to the excitation period for the step of M-36 (S007).

After the approach run, the recording head is driven by exciting the motor at DT which is the same as that of the approach run to record an image of input information on a recording medium (S008). After the recording, the variable M is defined as 36 (S009), and then the excitation period ΔT of the motor corresponding to the step M is selected from a deceleration table (not shown) for decelerating the carriage (S010 to S011). In the next step, the variable M is reduced by subtracting 1 from the M value obtained at the preceding steps (i.e., M=M−1) (S012) and then the excitation period ΔT corresponding to the step M is selected from the table.

These steps are repeated until the M takes the value 1 (S013). When the M takes the value of 1, the carriage's deceleration is terminated (S014).

In the case of recording a plurality of lines, furthermore, the process does not terminate at the step of S0043 but returns to the step of S001 to repeat the whole steps of controlling the carriage's acceleration and deceleration with an exception of moving the carriage at the initial position B1 (see FIG. 4) at the time of returning to the step of S001.

<Embodiment 2>

In the first embodiment, the carriage is stepwisely accelerated, excepting that there is one region where the acceleration does not occur (i.e., the rate of change of velocity with respect to time is zero). However, the present invention is not limited to such acceleration condition. A plurality of such regions or the regions where the acceleration is slowed may be provided until the acceleration is terminated.

Figure 10:
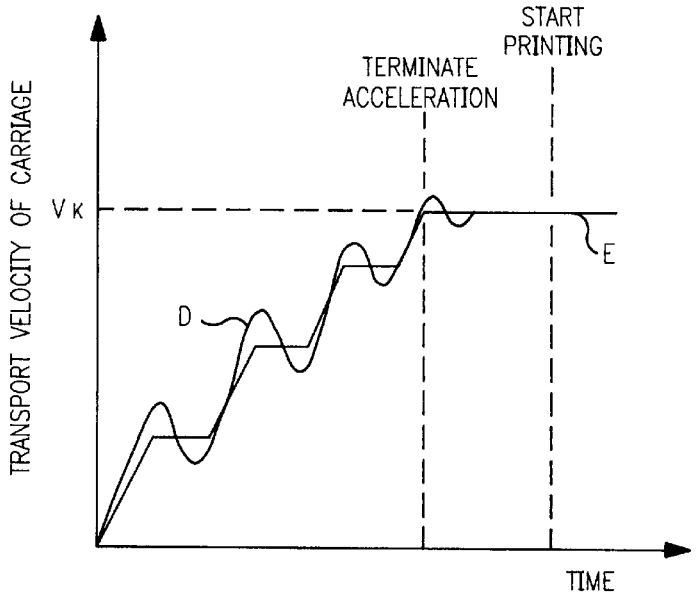
FIG. 10 is a graph showing an example of the relationship between an actual carriage's location and a carriage's drive control of a recording apparatus in accordance with the present invention.

FIG. 10 illustrates a relationship between the carriage's location and the control level Vk when the carriage is stepwisely accelerated. However, there are three regions where acceleration does not occur. The process of controlling the carriage's acceleration is almost the same as the process of the first embodiment. That is, the control level is listed in the table in advance to drive the carriage's motor.

In this embodiment, as shown in FIG. 10, the period of accelerating the carriage and the velocities of the carriage at successive times are the same as that of the first embodiment shown in FIG. 8. Comparing with FIG. 8, however, the carriage's acceleration is larger than that of the first embodiment because of more existing non-accelerating regions. In the case that the carriage's acceleration of FIG. 10 is the same as that of FIG. 9 with an exception of the number of the non-accelerating regions, the time required for the carriage's acceleration from the initial to the control level is prolonged. That is, a distance required for the carriage's acceleration becomes longer. Therefore, it is noted that the appropriate acceleration, the appropriate number of the non-accelerating regions, and the appropriate distance of such regions should be determined because of the above reasons.

<Embodiment 3>

For controlling an acceleration of the motor, in the above first embodiment, the excitation period thereof is determined by selecting the value from the table which is prepared in advance, but not limited to such table. In this embodiment, on the other hand, the excitation period may be calculated instead of that table.

Figure 11:
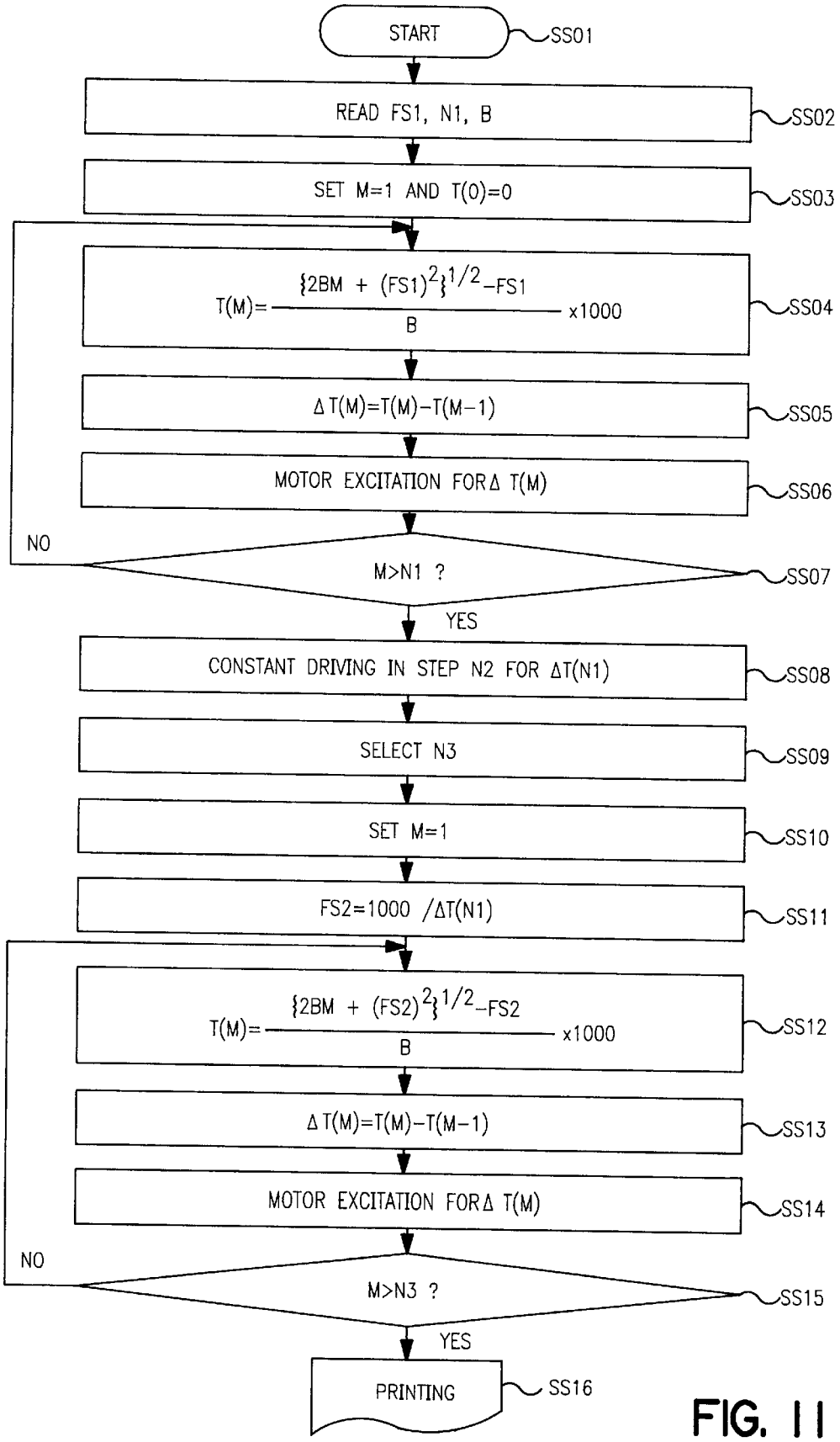
FIG. 11 is a block diagram showing another embodiment of the process for controlling a carriage's motion in a recording apparatus in accordance with the present invention.

FIG. 11 is a flowchart of controlling the carriage's acceleration by calculating an excitation period of the motor with the acceleration pattern including one non-accelerating region.

First of all, in the flowchart, the control unit receives orders of recording the image (SS01) and then read data of FS1(initial frequency), N1 (the number of accelerate steps), and B(acceleration), which are housed in ROM 1001 in advance (SS02). In MPU 1000, the variable M is fixed to 1 and T(0) is fixed to 0 (SS03). Using the factors of FS1, N1, and B, a total of excitation periods T(M) from the initial state is calculated (SS04). The excitation period ΔT is also calculated by the equation of DT(M)=T(M)−T(M−1), wherein T means the time of exciting the motor. Therefore, the motor is excited at the time interval of DT. In the next step, the steps of SS04 to SS06 are repeated until the variable M takes the value corresponding to the number of acceleration step N1 which is read by the step of SS02 (SS07) At the step of SS09, the carriage's acceleration at the first stage is terminated. Next, the motor excited N2 times. The N2 is corresponds to the number of steps in the non-accelerating region at the time interval of DT under the condition that the variable M takes the value of N1 (SS08). Then the number of acceleration steps in the second stage is read from ROM 1001 (SS09), while MPU 1000 resets its variable M to 1 (SS10). The initial frequency FS2 of the second stage is the same as a frequency of the first stage just after the acceleration, so that it can be calculated from 1/DT (N1) (SS11) and also calculated from T(M) as in the same manner of the first embodiment (SS12). Then the period ΔT of exciting the motor is calculated from T(M)−T(M−1) (SS13). Thus the motor is excited at the time interval of DT (SS14). After the step of SS14, the steps from SS12 to SS14 are repeated until the variable M becomes a predetermined value of N3 (SS15) When the M takes the value of N3, the acceleration at the second stage is terminated and then the recording head starts to perform the recording movement (SS16).

By the way, it is possible to provide an approach run between the time of terminating the acceleration and the time of starting the recording movement.

<Embodiment 4>

In the above embodiments 1 to 3, a uniform acceleration is performed during the acceleration stage, excepting the regiment of slow- or non-acceleration. However, it is also possible to use the process in which the carriage's acceleration is changed.

Figure 12:
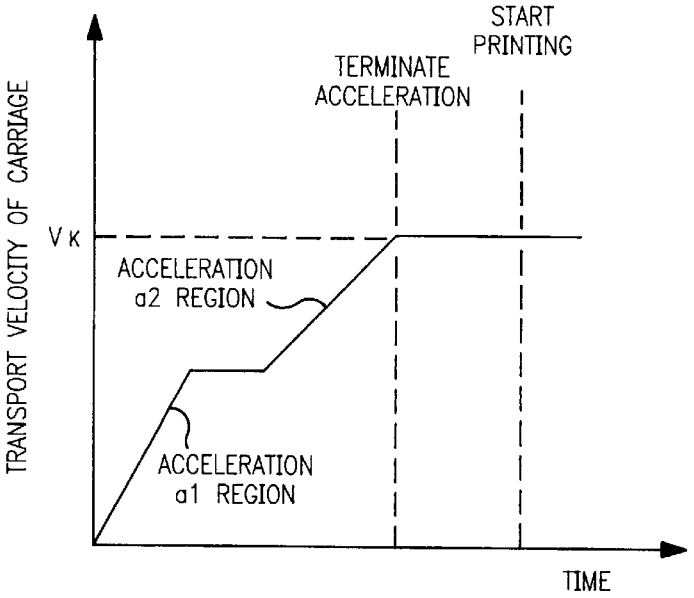
FIG. 12 is a graph showing a carriage's drive control of a recording apparatus in accordance with the present invention.

FIG. 12 shows the relationship between an elapsed time and a velocity of the carriage under the condition that the carriage's accelerations in opposite sides of the region of slow or non-acceleration are different. In this figure, there are two accelerating regions where the carriage travels at a uniform acceleration. However, their acceleration values a1 and a2 are different from each other. In this case, the variations in velocity just after the acceleration can be decreased. Furthermore, FIG. 13 shows the relationship between an elapsed time and a velocity of the carriage under the condition that the carriage's acceleration is changed exponentially with time, excepting that of the region of slow- or non-acceleration. It is noted that the acceleration without the above region may be controlled by an appropriate pattern of acceleration for the recording apparatus.

<Embodiment 5>

In the above embodiments 1 to 4, the slow acceleration region is provided in the stage of acceleration by which the carriage's velocity is increased from the rest state to the appropriate recording velocity. However, the present invention is not limited to the above construction. It is also possible to apply the present invention to the process of deceleration by which the carriage's velocity is decreased from the recording velocity to the rest state.

Figure 14:
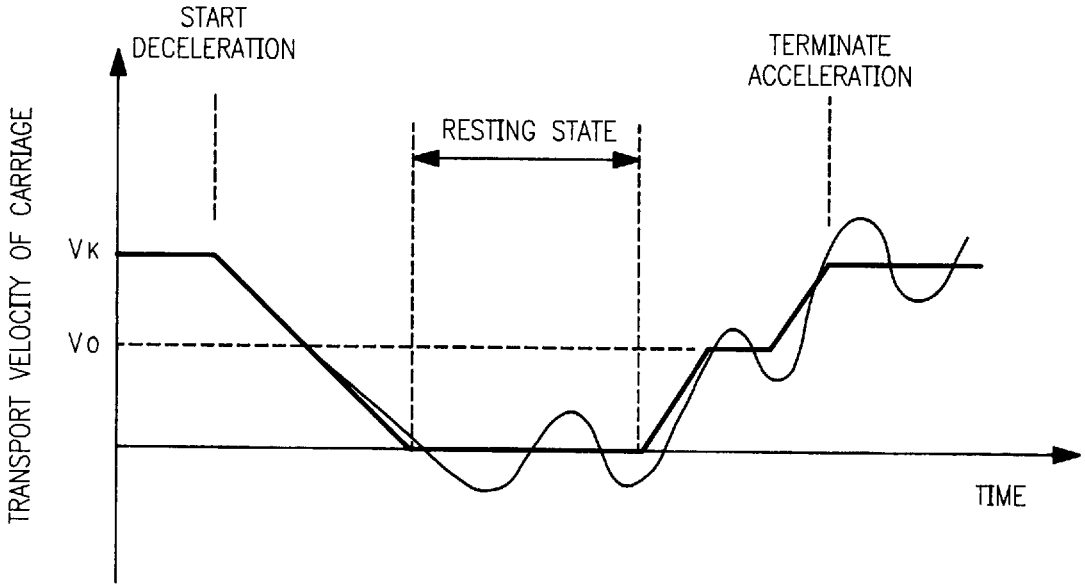
FIG. 14 is a graph showing a carriage's drive control of a recording apparatus in accordance with the present invention.

FIG. 14 shows the relationship between the carriage's position and the control level under the condition that a non-accelerating region is only provided on the period of accelerating the carriage. In this figure, that is, the carriage starts to decelerate at a certain point and once stops. Then the carriage starts to accelerate again.

In FIG. 14, the control level is indicated by a thick line while the carriage's position is indicated by a narrow line. When the deceleration is started, the carriage receives a force corresponding to the aforementioned force F which is applied on the carriage at the time of acceleration, under the conditions of the same accelerations and of receiving the forces in opposite directions. Therefore, the force becomes zero instantaneously at the time of stopping the carriage, causing oscillations in velocity to occur at this time.

In general, the carriage is accelerated again after converging the oscillation to a certain extent at intervals over time. However, when the duration of stopping the carriage's motion is elongated, the recording time (throughput) is also elongated. Therefore, the duration of stopping the carriage should be shortened as much as possible.

Figure 15:
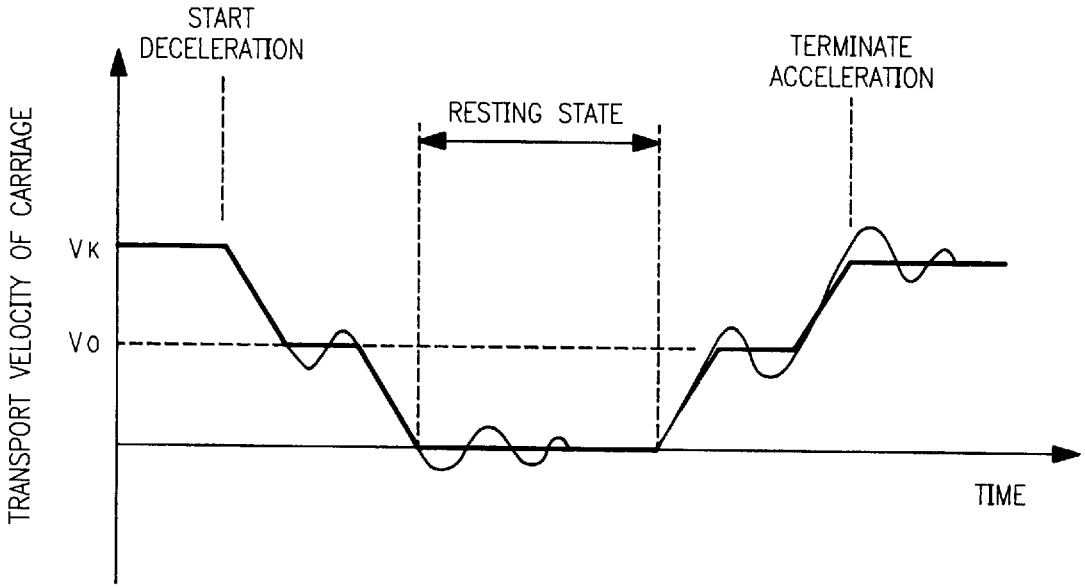
FIG. 15 is a graph showing a carriage's drive control of a recording apparatus in accordance with the present invention.

FIG. 15 shows the relationship between the carriage's position and the control level under the conditions that the non-accelerating regions are provided in the stages of deceleration and the acceleration, respectively. In the figure, the control level is indicated by a thick line while the carriage's position is indicated by a narrow line. By providing the non-accelerating region in the halfway of the stage of deceleration, variations in velocity can be decreased in the same way as the stage of acceleration. Therefore, the duration of stopping the carriage should be shortened as much as possible.

In this embodiment, the carriage's velocity Vo at the time of not causing acceleration in the acceleration stage is the same as that in the deceleration stage, but it is also possible to make one different from the other. Also, it is possible to use the different rates of changes in the velocities in other regions of both stages.

<Embodiment 6>

In the above embodiments, the stepping motor is used as a source of driving the carriage. In accordance with the present invention, however, the means for driving the carriage is not limited to the stepping motor, but also a DC motor, synchronization motor, induction motor, hysteresis motor, AC commutator motor, or the like can be used.

Figure 16:
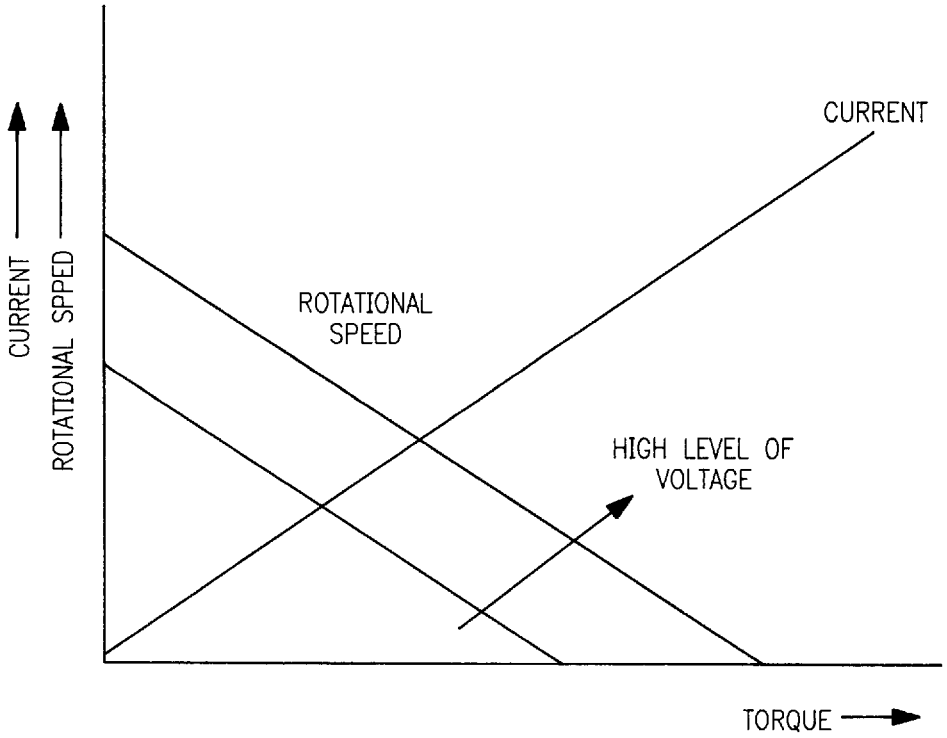
FIG. 16 is a graph showing an example of load characteristic of a DC motor as a carriage's driving source in a recording apparatus in accordance with the present invention.

FIG. 16 illustrates a load characteristic of the DC motor. As shown in the figure, a degree of the DC motor's torque is in proportion to a degree of current and a rotational frequency of the DC motor is increased with the changes in voltage. This means that the torque can be changed by changing the current level while the rotational frequency can be changed by changing the voltage level. Therefore, in the case of accelerating the motor from its rest state to a driving state with a predetermined rotational frequency, it is possible to make a non-acceleration region in the stage of acceleration. For example in the case of accelerating the motor by increasing the voltage up to 24 V, the acceleration is once discontinued (i.e., the acceleration takes the value of 0) at the voltage of 18 V by once suspending the change in voltage and then the acceleration is restarted by increasing the voltage up to 24 V. Alternatively, by making the rate of changing the voltage from 18 V to 18.5 V slower than the rate of changing the voltage of other adjacent ranges, the slow-accelerating region can be obtained.

By the way, the DC motor tends to change its velocity by the variations in load, so that a speed regulation device, such as an electronic speed governor or the like for detecting couter electromotive force, may be used. In this case, it is possible to regulate the non-accelerating region by such device.

<Embodiment 7>

In the above embodiments, the non-accelerating region is defined in the stage of acceleration with respect to drive the carriage of the ink jet recording head. In this embodiment, however, it is not limited to such ink jet recording apparatus. The process of acceleration as described in the above embodiments can be also applied in the other types of recording apparatuses or printing devices, such as heat sensitive, heat transfer, and wire-dot printers, and pen-plotter, copying machine, facsimile machine, and the like can be applied as well.

The process of acceleration as described in the above embodiments can be further applied in the driving mechanism, system or device using a motor as a source of driving force, such as a feed motor for feeding a recording medium, a recovering system's motor for driving a pump member used for the process of recovering ink ejection, a motor for winding up ink ribbon or a motor used for the process of head up and down in the heat sensitive or heat transfer type printer, and a motor for driving daisy wheel.

In recent years, the process for driving the carriage at the same time of feeding a recording medium has been employed in many recording apparatuses. According to such process, there are some cases where the recording movement is started almost at the same time of ending the process of feeding the recording medium. When the vibration of the feeding mechanism remains at the time of stopping the feed motor, therefore, there are possibilities of causing some trouble in the resulting image, for example black lines caused by increasing the number of overlapped portions between the present image and the previous image or white lines caused by increasing the number of spaced portions between the present image and the previous image, as a result of confusion in the image. To solve this problem, it is necessary to converge the vibration in the rest state as shown in FIG. 12 and FIG. 13 as soon as possible. For this purpose, a slow-accelerating region is defined in the state of deceleration to immediately converge the vibration as shown in FIG. 15.

In general, by the way, the mechanism for feeding a recording medium has an original configuration so as to fit to the type of the recording medium. It means that the overall force to which the mechanism is subjected in resisting externally applied forces, for example a feeding load is different in accordance with the type of the recording medium. In addition, the degree of the above vibration also depends on the load. Therefore, it is effective to individually determine the acceleration for each type of the recording medium, or individually determine the velocity in the slow-accelerating region or an extent of such region.

<Embodiment 8>

An ink jet recording apparatus of the present embodiment is constituted in the same way as that of the embodiments 1 to 7, excepting that a plurality of ink jet recording heads are arranged for color printing. That is, these recording heads are mounted on a carriage. In this case, a color image can be formed by ejecting ink droplets from the recording heads and placing the ink droplets one upon another. Generally, three or four recording heads with ink tanks corresponding to three primary colors of yellow (Y), magenta (M), and cyan (C) and a color of black (B) are required for recording the color image. Accordingly, the recording apparatus thus constructed can be used for full color image formation.

<Embodiment 9>

An information processing system of this embodiment comprises a computer and an ink jet recording apparatus as an output terminal of the computer. The ink jet recording apparatus is constructed by one of the above embodiments 1 to 8.

<Embodiment 10>

An information processing system of this embodiment is provided as a copying machine that comprises an ink jet recording head as an output device together with a reader device. The ink jet recording apparatus is constructed by one of the above embodiments 1 to 8.

<Embodiment 11>

An information processing system of this embodiment is provided as a facsimile machine having a mechanism of transmitter-receiver and an ink jet recording apparatus as its output terminal. The ink jet recording apparatus is constructed by one of the above embodiments 1 to 8.

It is noted the present invention is not limited to the above systems. The ink jet recording head of the present invention can be applied in various kinds of information processing systems, such as copying machines, facsimiles, printers, word processors, and personal computers, which require their output devices for outputting information including characters, pictures, or the like on a recording medium.

The present invention has been described in detail with respect to preferred embodiments, and it will now be that changes and modifications may be made without departing from the invention in its broader aspects, and it is the intentions that these fall within the true spirit of the invention.

What is claimed is:

1. A recording apparatus including a carriage, which moves relative to a recording medium, and on which a recording head for recording an image of input information on a recording region of the recording medium is mounted, and driving means for scanning said carriage, said recording apparatus comprising:

control means for scanning said carriage by said driving means by accelerating said carriage by stepwise changing a velocity of said carriage from a rest level to a predetermined level before printing each line, the accelerating of said carriage being achieved by driving said driving means to accelerate said carriage from the rest level to a first transient level at a first predetermined acceleration, then driving, at least until an actual velocity of the carriage begins to fall, said driving means to scan said carriage from the first transient level to a second transient level at a low acceleration which is less than the first predetermined acceleration, and then driving said driving means to accelerate said carriage from the second transient level to the predetermined level at a second predetermined acceleration which is greater than the low acceleration, and keeping the velocity of said carriage at the predetermined level.

2. A recording apparatus according to claim 1, the first predetermined acceleration being greater than the second predetermined acceleration.

3. A recording apparatus as claimed in claim 1, wherein said recording head includes a thermoelectric transducer for allowing a phenomenon of film boiling to appear in ink, said thermoelectric transducer serving to generate energy for ejecting ink droplets therefrom.

4. A recording apparatus as claimed in claim 1, wherein said recording head does not record said input image information on the recording medium when said control means is accelerating said carriage.

5. A recording apparatus as claimed in claim 1, wherein an acceleration at the predetermined level takes a value of 0.

6. A recording apparatus as claimed in claim 1, wherein said control means for scanning said carriage decelerates said carriage by stepwise changing the velocity of said carriage from the predetermined level to the rest level.

7. A recording apparatus as claimed in claim 6, wherein said control means decelerates said carriage by decelerating said carriage from the predetermined level to a predetermined decelerating transient level, and then decelerating said carriage from the predetermined decelerating transient level to the rest level.

8. A recording apparatus as claimed in claim 7, wherein a deceleration from the predetermined level to the predetermined decelerating transient level is different from a deceleration from the predetermined decelerating transient level to the rest level.

9. A recording apparatus as claimed in claim 7, wherein a deceleration from the predetermined level to the predetermined decelerating transient level is larger than a deceleration from the predetermined decelerating transient level to the rest level.

10. A recording apparatus as claimed in claim 6, wherein a deceleration in the predetermined level takes a value of 0.

11. A recording apparatus as claimed in claim 1, wherein said control means selects one velocity from a plurality of velocities as the predetermined level.

12. A recording apparatus as claimed in claim 11, wherein said control means determines a rate of acceleration with respect to the selected velocity.

13. A recording apparatus as claimed in claim 6, wherein said control means determines a rate of acceleration and a rate of deceleration with respect to a moment of inertia or a load condition of said driving means.

14. A recording apparatus as claimed in claim 1, wherein said driving means is a pulse motor to be driven in accordance with a pulse signal.

15. A recording apparatus as claimed in claim 1, wherein said driving means is a DC motor.

16. An information processing system using a recording apparatus as an output means, said recording apparatus including a carriage, which moves relative to a recording medium, and on which a recording head for recording an image of input information on a recording region of the recording medium is mounted, and driving means for scanning said carriage, said information processing system comprising:

control means for scanning said carriage by said driving means by accelerating said carriage by stepwise changing a velocity of said carriage from a rest level to a predetermined level before printing each line, the accelerating of said carriage being achieved by driving said driving means to accelerate said carriage from the rest level to a first transient level at a first predetermined acceleration, then driving, at least until an actual velocity of the carriage begins to fall, said driving means to scan said carriage from the first transient level to a second transient level at a low acceleration which is less than the first predetermined acceleration, and then driving said driving means to accelerate said carriage from the second transient level to the predetermined level at a second predetermined acceleration which is greater than the low acceleration, and keeping the velocity of said carriage at the predetermined level.

17. An information processing system as claimed in claim 16, wherein said information processing system is a copying machine.

18. An information processing system as claimed in claim 16, wherein said information processing system is a facsimile machine.

19. An information processing system as claimed in claim 16, wherein said information processing system is a personal computer.

20. A method of recording an image of input information on a recording medium by a recording apparatus, said recording apparatus including a carriage, which moves relative to said recording medium, and on which a recording head for recording said image of input information on a recording region of the recording medium is mounted, and driving means for driving said carriage, said method comprising the step of:

driving said carriage by said driving means in accordance with a driving process of:

an acceleration step for accelerating said carriage by stepwise changing a velocity of said carriage from a rest level to a predetermined level before printing each line, said acceleration step including a first acceleration sub-step for driving said driving means to accelerate said carriage from the rest level to a first transient level at a first predetermined acceleration, a low acceleration sub-step for driving said driving means to accelerate said carriage from the first transient level to a second transient level at a low acceleration which is less than the first predetermined acceleration, and a second acceleration sub-step for driving said driving means to accelerate said carriage from the second transient level to the predetermined level at a second predetermined acceleration which is greater than the low acceleration, wherein said low acceleration sub-step is performed at least until an actual velocity of said carriage begins to fall; and a retaining step for keeping the velocity of said carriage at the predetermined level.

21. The method according to claim 20, the first predetermined acceleration being greater than the second predetermined acceleration.

22. A method as claimed in claim 20, wherein said recording head includes a thermoelectric transducer for allowing a phenomenon of film boiling to appear in ink, said thermoelectric transducer serving to generate energy for ejecting ink droplets therefrom.

23. A method as claimed in claim 20, wherein said driving means is a DC motor.

24. A method as claimed in claim 20, wherein said retaining step selects one velocity from a plurality of velocities as said predetermined velocity.

25. A method as claimed in claim 20, wherein said driving means is a pulse motor to be driven in accordance with a pulse signal.

26. A method as claimed in claim 20, wherein said control means determines a rate of acceleration in said acceleration step with respect to a moment of inertia or a load condition of said driving means.

27. A method as claimed in claim 20, wherein an acceleration at said predetermined level of said acceleration step takes a value of 0.

28. A method as claimed in claim 20, further comprising a process comprising a deceleration step for decelerating said carriage by stepwise changing said velocity of said carriage from said predetermined level to said rest level.

29. A method as claimed in claim 28, wherein said deceleration step comprises at least two sub-steps including a first deceleration sub-step for decelerating said carriage from said predetermined level to a predetermined decelerating transient level, and a second deceleration sub-step for decelerating said carriage from said predetermined decelerating transient level to said rest level.

30. A method as claimed in claim 29, wherein a rate of deceleration in said first deceleration sub-step is different from a rate of deceleration in said second deceleration sub-step.

31. A method as claimed in claim 29, wherein a rate of deceleration of said first deceleration sub-step is larger than a rate of deceleration of said second deceleration sub-step.

32. A method as claimed in claim 28, wherein a rate of deceleration in said predetermined level of said deceleration step takes a value of 0.

33. A method as claimed in claim 28, wherein said recording head does not record said input image information on said recording medium in both said acceleration step and said deceleration step.

34. A method as claimed in claim 20, wherein said control means determines a rate of acceleration in said acceleration step with respect to said selected velocity.

* * * * *

UNITED STATES PATENT AND TRADEMARK OFFICE

CERTIFICATE OF CORRECTION

PATENT NO. : 5,871,291

DATED : February 16, 1999

INVENTOR(S) : KENJI KAWAZOE

It is certified that error appears in the above-identified patent and that said Letters Patent is hereby corrected as shown below:

Title page, item

AT [56] REFERENCES CITED

"Nizhizawa et al." should read --Nishizawa et al.--; and
"5,433,451" should read --5,433,541--.

In the drawings:

FIG. 16

"SPPED" should read --SPEED--.

COLUMN 2

Line 45, "at" should be deleted.

UNITED STATES PATENT AND TRADEMARK OFFICE

CERTIFICATE OF CORRECTION

PATENT NO. : 5,871,291

DATED : February 16, 1999

INVENTOR(S) : KENJI KAWAZOE

It is certified that error appears in the above-identified patent and that said Letters Patent is hereby corrected as shown below:

COLUMN 3

Line 48, "the" (first occurrence) should be deleted.

COLUMN 4

Line 15, "high-qualified image" should read --high- quality image--; and
Line 19, "a" should read --the--.

COLUMN 7

Line 14, "carriage's" (both occurrences) should be deleted; and
Line 58, "motion" should read --a--.

UNITED STATES PATENT AND TRADEMARK OFFICE

CERTIFICATE OF CORRECTION

PATENT NO. : 5,871,291

DATED : February 16, 1999

INVENTOR(S) : KENJI KAWAZOE

It is certified that error appears in the above-identified patent and that said Letters Patent is hereby corrected as shown below:

COLUMN 8

Line 63, "to" (second occurrence) should read --the--.

COLUMN 10

Line 55, "accelerations" should read --acceleration,--.

COLUMN 12

Line 46, "additional 1" should read --an additional 1--.

COLUMN 13

Line 54, "read" should read --reads--.

UNITED STATES PATENT AND TRADEMARK OFFICE

CERTIFICATE OF CORRECTION

PATENT NO. : 5,871,291

DATED : February 16, 1999

INVENTOR(S) : KENJI KAWAZOE

It is certified that error appears in the above-identified patent and that said Letters Patent is hereby corrected as shown below:

COLUMN 14

Line 1, "excited" should read --is excited--, and "is" should be deleted;
Line 26, "regiment" should read --region--; and
Line 57, "once" should read --at once--.

COLUMN 15

Line 52, "couter" should read --counter--.

COLUMN 17

Line 12, "intentions" should read --intention--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*